US005339607A

United States Patent [19]

Regier

[11] Patent Number: 5,339,607

[45] Date of Patent: Aug. 23, 1994

[54] APPARATUS AND METHOD FOR DISPENSING OBJECTS TO A COUNT AND/OR WEIGHT

[76] Inventor: Robert D. Regier, 25 Trout Lake Dr., Sanger, Calif. 93657

[21] Appl. No.: 965,873

[22] Filed: Oct. 23, 1992

[51] Int. Cl.[5] ..... B65B 1/34; B65B 1/46; B65B 57/20

[52] U.S. Cl. ..... 53/501; 53/240; 53/443; 53/475; 53/502

[58] Field of Search ..... 53/443, 475, 501, 500, 53/502, 240, 244, 498

[56] References Cited

U.S. PATENT DOCUMENTS

| | | | |
|---|---|---|---|
| 3,200,559 | 8/1965 | Curtis | 53/501 |
| 3,207,909 | 9/1965 | Lakso et al. | 250/223 |
| 3,492,779 | 2/1970 | Russell | 53/501 |
| 3,705,475 | 12/1972 | Riley | 53/502 X |
| 3,877,199 | 4/1975 | Lipes | 53/59 R |
| 4,074,507 | 2/1978 | Ruf et al. | 53/502 |
| 4,137,689 | 2/1979 | McClusky et al. | 53/502 |
| 4,177,621 | 12/1979 | Powell, Jr. | 53/502 X |
| 4,183,192 | 1/1980 | Smaw | 53/444 |
| 4,733,359 | 3/1988 | Luperti et al. | 364/478 |
| 4,953,343 | 9/1990 | Hellman | 53/500 |
| 4,999,977 | 3/1991 | Briscoe et al. | 53/501 |
| 5,010,715 | 4/1991 | Fluck | 53/502 X |
| 5,029,431 | 7/1991 | Weening et al. | 53/437 |

*Primary Examiner*—James F. Coan
*Attorney, Agent, or Firm*—Madson & Metcalf

[57] ABSTRACT

An apparatus for dispensing a predetermined count and/or weight of objects into a receptacle includes a conveyor, an object sensor, a controller, a trickle-feed conveyor, and a receptacle conveyor. The conveyor conveys the objects and has at least one grouping assembly which is capable of capturing a group of objects and supporting that group of objects during conveyance. The object sensor is disposed to detect the presence of each of the groups of objects prior to discharge and relays information relating to the number of objects within each group of objects. The controller communicates with the object sensor, monitors the information relayed, generates instructions, and tracks the location of each grouping assembly from detection to discharge into the receptacle. The controller also monitors the number of objects in each group of objects discharged into the receptacle. The trickle-feed conveyor conveys objects for discharge one at a time into the receptacle in response to instructions received from the controller. The receptacle conveyor positions the receptacle in the proximity of the conveyor in response to instructions received from the controller so that the receptacle receives objects from the groups of objects discharged from the conveyor up to but not exceeding the predetermined count or weight of objects. The receptacle conveyor also moves the receptacle from the proximity of the conveyor to the proximity of the trickle-feed conveyor so that the receptacle can receive objects discharged from the trickle-feed conveyor until the receptacle has received the predetermined count or weight of objects.

34 Claims, 5 Drawing Sheets

APPARATUS AND METHOD FOR DISPENSING OBJECTS TO A COUNT AND/OR WEIGHT

FIELD OF THE INVENTION

The present invention relates to an apparatus used for dispensing a predetermined count and/or weight of objects into a receptacle, and more particularly to an apparatus that groups the objects, counts the objects in each group, tracks each group, counts the objects discharged into the receptacle, halts the discharge of further groups of objects if the next group would over-fill the receptacle, and trickle-feeds objects into the receptacle until a predetermined count or weight is reached.

BACKGROUND OF THE INVENTION

Prior to transporting harvested produce to market, one of the major tasks which must be performed is that of properly sorting the produce and packaging the produce for distribution. Typically, produce is sorted and packaged using a number of criteria, including size, weight, shape, color, quality, and quantity.

The presorting of produce has a number of advantages for both consumers and produce growers. For example, through presorting, poor or spoiled produce can be removed prior to packaging, thereby reducing the likelihood of spoilage of the remaining produce during subsequent transportation and storage. The presorting of produce also permits consumers to purchase produce having general characteristics which are compatible with their needs. A restaurant owner, for example, may desire consistently to purchase some types of produce so that all of the pieces of such produce are of a substantially uniform size and quality. Further, the presorting of produce facilitates packaging and storing, since the sorted produce may usually be neatly arranged on trays or in crates.

In the past, the sorting of produce has been accomplished in a number of ways. Originally, produce was sorted entirely by hand, with the sorters being given instructions and training relating to the predetermined sorting criteria. Such a sorting method is tedious and quite imperfect, giving rise to numerous errors due to both human inconsistency and to varying applications of the sorting criteria by different individuals. Accordingly, although some hand sorting is still carried out in the produce industry, most produce sorting is now done mechanically.

Now that a considerable amount of the presorting of produce is done mechanically, the sorting function is completed much faster than sorting by hand. Throughput of the produce during sorting and packaging has been dramatically improved, but there still remains problems. If the produce cannot be sorted and packaged rapidly enough, some produce rots in the fields or reaches the marketplace in less than optimum condition. In order to stretch out the harvest season, some items of produce are harvested early and not allowed to ripen in the fields, but rather ripen in transit or on a shelf at the home of the consumer. This practice does not provide consumers with the most nutritious or pleasing produce. The best produce is that which is ripened in the fields and rushed to the consumer while still in its optimum condition. Hence, there is an extreme amount of pressure to harvest the produce and rush it to the consumer as rapidly as possible.

Due to the above-mentioned pressures and drawbacks, attempts have been made to develop more efficient and reliable methods for sorting produce mechanically. One of the most promising sorting methods currently in use involves scanning the produce optically in order to ascertain its characteristics. This sorting method offers the potential for greatly increasing the speed, accuracy and reliability of sorting by size, as well as the opportunity to sort on the basis of other visual characteristics.

Although the structural requirements for a suitable optical sorting apparatus vary somewhat depending upon the type of objects to be sorted, an effective optical sorting apparatus must generally perform three separate operations. First, the objects must be singulated (i.e., the individual objects must be separated physically one from another). Secondly, each object must then be individually scanned or examined in order to ascertain its characteristics. Finally, the individual objects must be sorted mechanically based upon the information obtained during scanning. Thus, an effective sorting apparatus must make provisions for effective singulating, scanning, and mechanical sorting.

These three individual functions may be performed, either by a single machine, or by a number of separate cooperating devices. Some optical sorting systems are quite complex and process a large amount of produce in a short time.

After the produce is presorted, it must be packaged for distribution. Such packaging is accomplished using various types of receptacles such as cartons, boxes, bags, and crates. Since throughput is so critically important, the speed of the packaging process must be capable of matching or exceeding the speed of the sorting process where multiple automated sorting lines may be used to feed a single box or carton filler.

To complicate matters, governmental regulatory requirements for various types of produce may require information about the produce such as an exact count or the average weight of each article of produce within the receptacle. When such information is required, the throughput of the produce at the packaging stage can be significantly hindered. With presently known box or carton fillers, it simply takes time to count each individual article of produce as it is placed in the receptacle and/or to determine, with any degree of accuracy, the average weight of each article of produce.

In an effort to address the needs for throughput and required information about the produce, a few automated box or carton fillers have been developed. One such device relies on detecting weight and inferring the count of articles within the receptacle. First, the device rough-fills the receptacle to almost full using an electronic spring trip activated at a rough weight. Then, articles of produce are trickled in one at a time, weighing after each new addition, until the desired weight is obtained. Since the articles are presorted and a size range is known for each article, the average weight for each article can be estimated and an estimate of the total count of articles within the receptacle can be made.

Another device utilizes a slightly different approach. First, the device crude fills the receptacle to almost full using an electronic weighing mechanism. Then, by estimating the average weight of the articles, the number of articles needed to fill the receptacle to a predetermined count is calculated and added to the receptacle. The added weight is determined so that the actual average weight of the added articles is determined. That average weight is assumed to hold true for the entire contents of the receptacle. The device then accumulates the calculation over time so that a running tally of the average weight of the added articles is determined.

Both of these devices have significant deficiencies. The former device infers the count from the weight and the weight is assessed after each article is trickled in one at a time. This repeated weighing slows the packaging process. Additionally, the count and the average weight are estimated rather than precise and accurate. With the latter device, the average weight of the articles within each receptacle is inferred and the average weight of the articles added to each receptacle is calculated and averaged over time. Although this device is faster than the former device, it still infers the total count and the average weight of the articles within any given receptacle.

What is needed in the produce sorting and packaging industry is a box or carton filler that accurately counts the articles of produce, can accurately fill to a desired weight, and is capable of calculating the average weight of the articles of produce within each receptacle without sacrificing throughput.

OBJECTS AND BRIEF SUMMARY OF THE INVENTION

In view of the foregoing needs and problems experienced by the produce sorting and packaging industry, it is a primary object of the present invention to provide an apparatus that can rapidly fill a receptacle to a predetermined count and calculate the average weight of the articles of produce contained within each receptacle.

It is another object of the present invention to provide an apparatus that counts the articles of produce in groups rather than one at a time so that throughput is not unnecessarily hindered or delayed.

A further object of the present invention is to provide accurate and precise counts and weights so that the producer can enjoy cost savings incident to avoiding the over-filling of the packaging receptacles.

Still another object of the present invention is to provide an apparatus that is capable of filling a box or carton to a specified weight with a known count of the articles within the box or carton.

Another object of the present invention is to provide an apparatus that can vary the count of objects discharged into a box or carton to achieve a desired weight and can adjust the predetermined count over time periodically or as often as box by box.

The foregoing objects are accomplished by an apparatus of the present invention which counts each article of produce and weighs the contents of the receptacle filled to a predetermined count and/or weight so that the average weight of the articles of produce within the receptacle is accurately calculated.

In one preferred embodiment of the present invention the apparatus which dispenses a predetermined count and/or weight of articles of produce into a receptacle includes a conveyor, an object sensor, a controller, a trickle-feed conveyor, and a receptacle conveyor. The conveyor conveys the articles of produce on an elevated conveyor comprising a plurality of elongate cylindrical rollers connected in an endless belt configuration. Each pair of adjacent cylindrical rollers defines a grouping assembly which is capable of supporting articles of produce during conveyance. Each grouping assembly is capable of capturing more than one article of produce for conveyance in a group.

The object sensor is positioned to detect the presence of each of the groups of articles of produce prior to the conveyor discharging the group into the receptacle. The object sensor also relays information relating to the number of articles of produce within each group of articles. In a preferred embodiment of the present invention, the object sensor comprises a light emitter and a light detector. The light emitter is disposed adjacent to the conveyor so that the light detector can detect the light emitted through gaps between the cylindrical rollers of each grouping assembly. The light detector, preferably a line scan camera, is also capable of detecting the absence of light if articles of produce are being conveyed upon one of the grouping assemblies as that grouping assembly's gap passes between the light emitter and the light detector.

To assist in timing the detection of the presence or absence of light, an encoder is provided to determine when one of the gaps is disposed between the light emitter and the light detector. The encoder communicates the presence of the gap so that the light detector can interrogate the gap for the presence of light.

The controller communicates with the object sensor, monitors the information relayed from the object sensor, generates instructions for various components of the apparatus, and tracks the location of each grouping assembly from detection to discharge into the receptacle. The controller also monitors the number of articles of produce in each group of articles discharged into the receptacle so that instructions are sent to actuate and deactivate the trickle-feed conveyor, the receptacle conveyor, and the discharge of articles into the receptacle.

The trickle-feed conveyor conveys articles of produce for discharge one at a time into the receptacle in response to instructions received from the controller. The trickle-feed conveyor can rapidly fill the rough-filled receptacle to the desired count, because the controller has calculated precisely how many more articles of produce are needed to fill the receptacle.

The receptacle conveyor positions receptacles to receive articles being discharged from the conveyor and the trickle-feed conveyor. At a first stage of conveyance, an empty receptacle (e.g., a box or carton) is positioned for advancement to a second stage. Upon advancement to the second stage, the receptacle is positioned in the proximity of the conveyor so that the receptacle receives articles of produce from the groups of articles discharged from the conveyor. Groups of articles are discharged into the receptacle until the next group of articles would cause the count of articles to exceed the predetermined count. The receptacle conveyor also moves the receptacle to a third stage in the proximity of the trickle-feed conveyor so that the receptacle can receive objects discharged from the trickle-feed conveyor until the receptacle has received the predetermined count and/or weight of objects.

In another embodiment of the present invention the apparatus also comprises an accumulator disposed to receive groups of articles discharged from the conveyor before directing the articles into the receptacle. The accumulator comprises a hopper and at least one rotatable cylindrical brush. The hopper has a mouth for receiving discharged articles, a neck for gathering the articles, and an opening through which the articles of produce are directed into the receptacle. Preferably two cylindrical brushes are disposed to obscure passage through the opening unless the cylindrical brushes are rotated in opposite directions so that objects may pass between the pair of cylindrical brushes. The cylindrical brushes can be rotated and paused from rotation so that articles of produce pass into the receptacle by passing between the cylindrical brushes during rotation, and if rotation is paused, the articles accumulate within the hopper until rotation is recommenced.

These and other objects and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
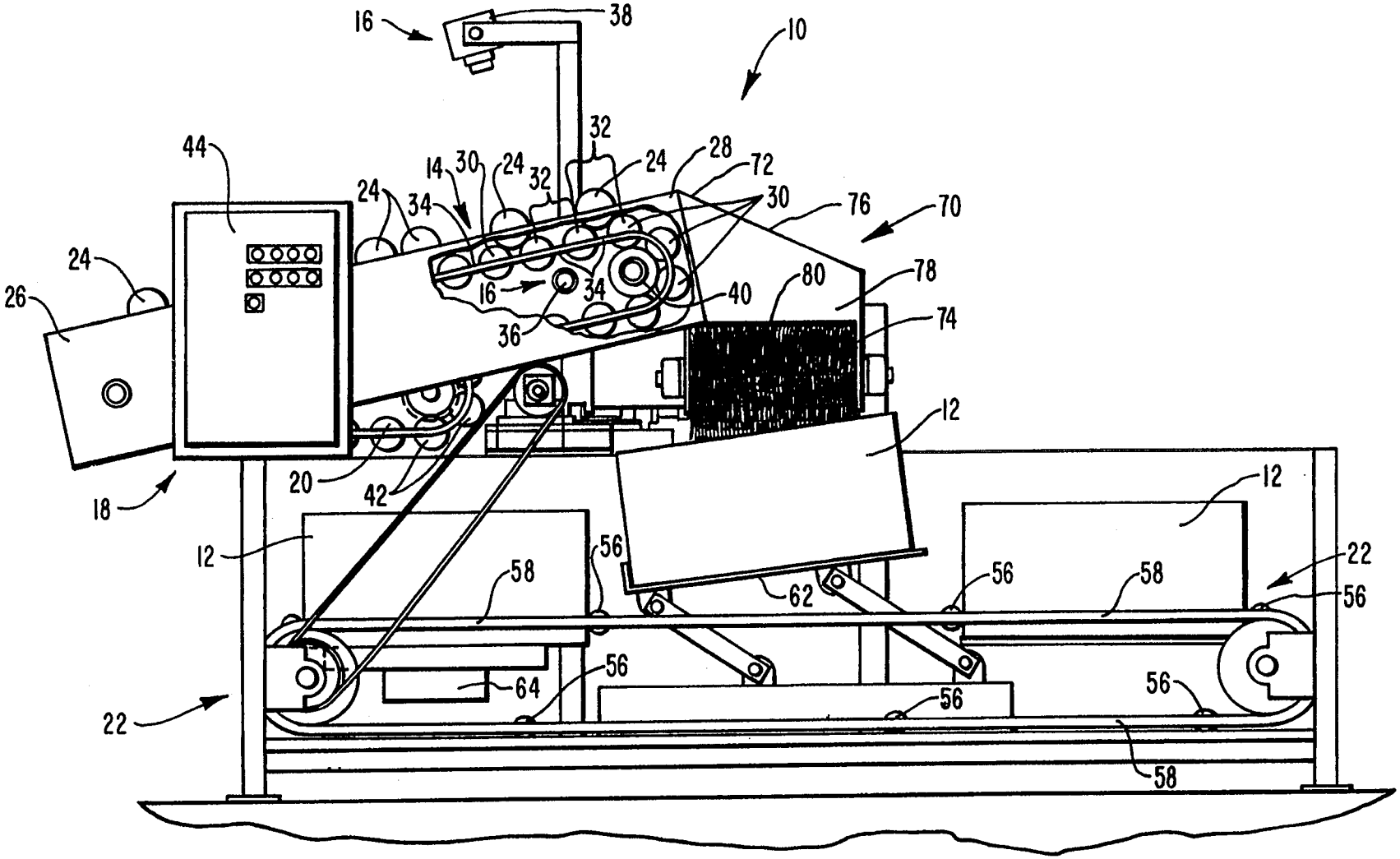
FIG. 1 is an elevational view of the apparatus of the present invention with a portion thereof cut away to show a portion of the conveyor.

The apparatus of the present invention may be used in connection with the packaging of a number of different types of products, but that disclosed herein finds its primary utility in connection with a mechanical produce sorter, particularly of objects, such as articles of produce, which are typically sorted on the basis of weight and/or visual characteristics and which require careful handling to prevent or minimize damage to the objects being sorted. Produce such as fruits for example, citrus fruits, stone fruits, apples, avocados, kiwi fruit, and also vegetables such as onions, potatoes, beets and the like are often packaged into boxes or cartons after being presorted. These types of produce may be packaged using the apparatus of the present invention. However, it should be understood that other types of products that may be packaged to a particular count or weight such as marbles, balls, and the like may be packaged using the apparatus of the present invention. Hence, for the purposes of this description, the term "object" will be used to indicate the product being packaged.

Also, for the purposes of this description, the term "receptacle" is used to indicate a box, carton, container, crate, and the like. In the drawings, the receptacle is a box; however, it should be understood that with slight modification by one skilled in the art, other types of receptacles could be used.

Referring now specifically to the drawings, wherein like numerals indicate like parts throughout, FIG. 1 illustrates the general configuration of the apparatus of the present invention. For ease of description, the apparatus will be generally referred to as the box filler and will be designated generally by the reference number 10. In one preferred embodiment of the present invention the box filler 10 which dispenses a predetermined count or weight of objects into a receptacle 12 includes a conveyor 14, an object sensor 16, a controller 18, a trickle-feed conveyor 20, and a receptacle conveyor 22.

The conveyor 14 conveys objects 24 from a receiving end 26 to a discharge end 28. To assist in the singulation of the objects 24 and to avoid stacking of objects 24 one on top of the other, the conveyor 14 can be elevated from the receiving end 26 to the discharge end 28. Preferably, the conveyor 14 comprises a plurality of elongate cylindrical rollers 30 connected in an endless belt configuration, as best shown in FIG. 1. Each pair of adjacent cylindrical rollers 30 defines a grouping assembly 32 with a conveying trough which is capable of supporting objects 24 resting between and upon the rollers 30 during conveyance. Hence, each cylindrical roller 30 can be part of two adjacent grouping assemblies 32.

Typically, the objects 24 are presorted for size, color, defects, weight, or other characteristics before being discharged in bulk onto the receiving end 26 of the conveyor 14. Each grouping assembly 32 is capable of capturing objects 24 from the bulk of objects 24 for conveyance as a group of objects 24 resting within the conveying trough for that grouping assembly 32. In this manner, objects 24 are aligned within the conveying trough for one of the grouping assemblies 32 for conveyance from the receiving end 26 to the discharge end 28 of the conveyor 14. To assure secure singulated, nonstacked travel of the objects 24 on the conveyor 14, the rollers 30 may be free to rotate about their longitudinal axis so that unstable objects 24 seeking a position of stability may cause one or more of the rollers 30 to rotate, or the rollers 30 may be rotated mechanically to move unstable objects 24 to a stable position for conveyance.

Preferably, each roller 30 is spaced from the next adjacent roller 30 so that there is a gap 34 between each pair of rollers 30. This gap 34 determines the size of each conveying trough for each grouping assembly 32. Of course, if marbles or small fruit such as kiwi are being handled, each gap 34 must be relatively small so that the objects 24 handled do not fall or wedge between the rollers 30. However, each gap 34 may be much larger if the objects 24 are larger such as would be the case with oranges or grapefruit.

Figure 3:
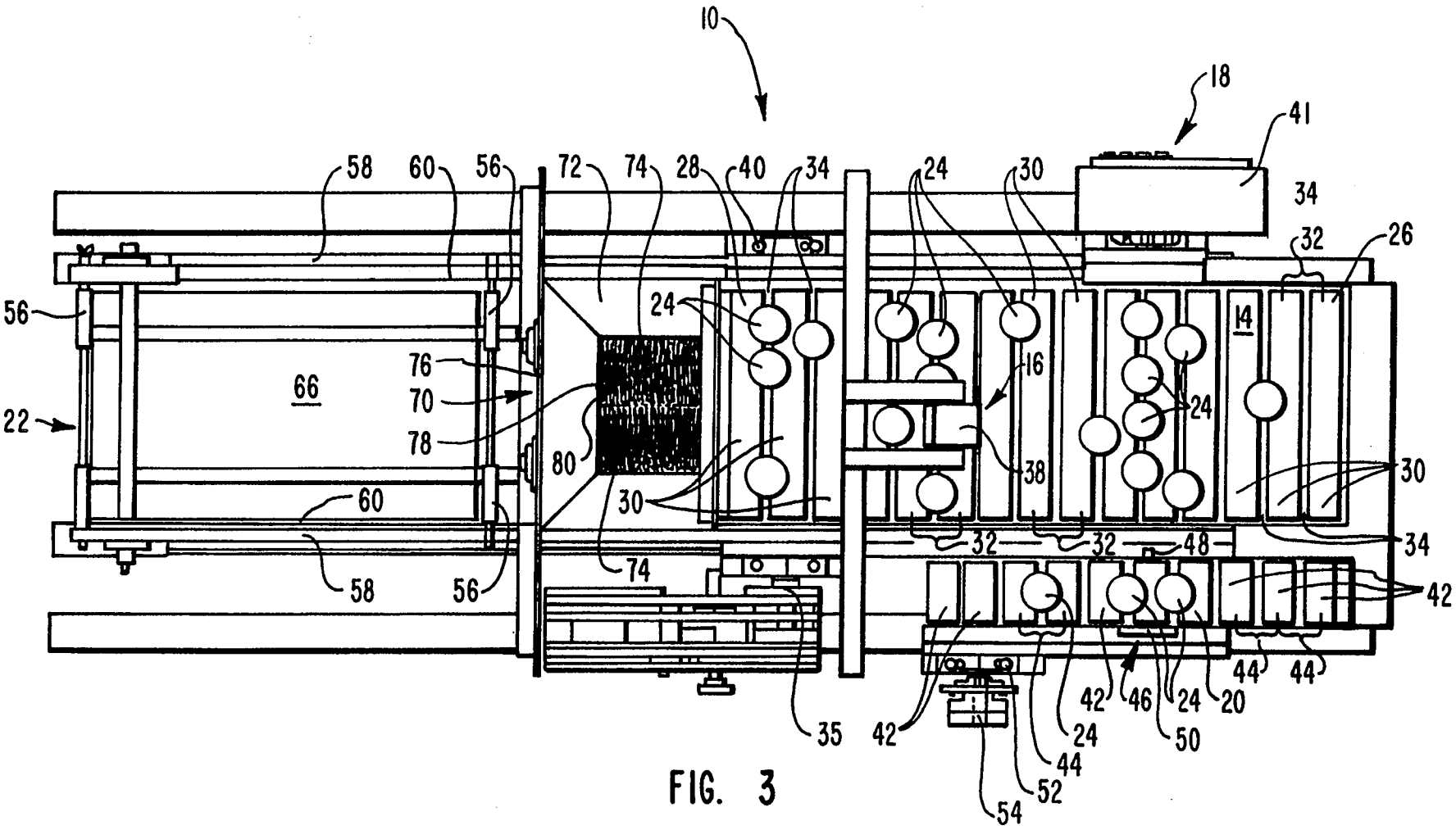
FIG. 3 is a top plan view of the apparatus showing the conveyor, the brushes of the accumulator, and the trickle-feed conveyor.
Figure 4:
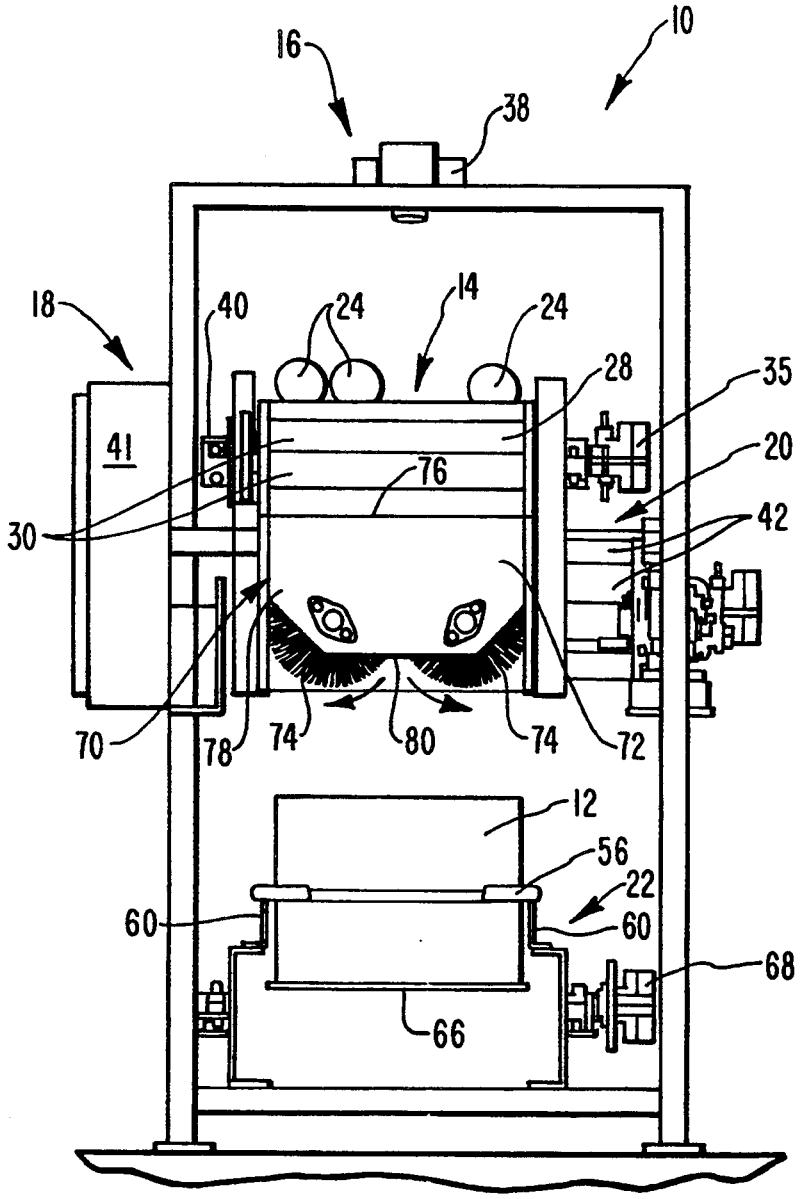
FIG. 4 is an end elevational view of the apparatus showing the discharge end of the conveyor and the accumulator.

As described, the conveyor 14 captures objects 24 in groups of objects 24 and conveys them in such groups from the receiving end 26 to the discharge end 28. A random example of such conveyance is shown in FIG. 3. The conveying trough for any given grouping assembly 32 may contain no objects 24, one object 24, or more than one object 24. Since the box filler 10 is capable of conveying and counting multiple objects 24 at once, the box filler 10 has a very advantageous throughput capability. The conveyor 14 rough-fills the receptacle 12 to a number of objects 24 up to but not exceeding the predetermined count. Further filling of the receptacle 12 by the conveyor 14 is then stopped, and the filling of the receptacle 12 to the exact count and/or weight is then accomplished by the trickle-feed conveyor 20 as will be described in more detail below. Stoppage of the further discharge of groups of objects 24 from the conveyor 14 can be accomplished in a number of ways. One way is to provide the conveyor 14 with a clutch 35 which pauses the conveyor 14 to allow the rough-filled receptacle 12 to be removed and an empty receptacle 12 to be positioned to receive groups of objects 24 from the conveyor 14. Other preferred ways to stop discharge into a rough-filled receptacle 12 is to provide an accumulator (to be described in some detail below) or a combination of a clutch 35 and an accumulator. In order not to overly hinder throughput, stoppage of discharge from the conveyor 14 into a receptacle 12 should be minimized.

The object sensor 16 is positioned to detect the presence of each of the groups of objects 24 prior to the conveyor 14 discharging each group into a receptacle 12. The object sensor 16 also relays information relating to the number of objects 24 within each group of objects 24. In a preferred embodiment of the present invention, the object sensor 16 comprises a light emitter 36 such as a lamp and a light detector 38. However, it should be understood that the object sensor 16 may comprise other sensing devices that may not require a light emitter. For example, present scanning technology can use incident light to scan objects without using a light emitter or relying on objects causing opacity.

In the preferred embodiment, the light emitter 36 is disposed adjacent to and beneath the advancing run of rollers 30 on the conveyor 14 (best shown in FIG. 1) so that the light detector 38 can detect the light emitted through the gaps 34 between the cylindrical rollers 30 of each grouping assembly 32 as each grouping assembly 32 advances from the receiving end 26 to the discharge end 28. The light emitter 36 can be positioned to emit light through the full length of each gap 34 when any such gap 34 aligns with the light communication between the light emitter 36 and the light detector 38.

The light detector 38 can take any of a number of known forms, for example, it may be a line of photo detectors or an area scan device, but preferably the light detector is a line scan camera. The light detector 38 is capable of detecting light and the absence of light if objects 24 are being conveyed upon one of the grouping assemblies 32, thereby obscuring a portion of light, as the gap 34 for that grouping assembly 32 passes between the light emitter 36 and the light detector 38. The light detector 38 relays information relating to the number of objects 24 within each group of objects 24 (i.e., the light and absence of light detected). That information is relayed to the controller 18 which counts the pixels in a length where light is absent and interprets those lengths where light is absent as one or more objects 24. Hence, the controller 18 counts the number of objects 24 conveyed in a conveying trough for a grouping assembly 32 by interpreting the length of intervals of light and the absence of light.

To assist in timing the detection of the presence or absence of light, an encoder 40 is provided to determine when one of the gaps 34 is disposed between the light emitter 36 and the light detector 38. The encoder 40 communicates the presence of the gap 34 to the controller 18 or directly to the light detector 38 so that the light detector 38 is activated and interrogates the gap 34 for the presence of light and the absence of light.

The controller 18 comprises a computer microprocessor based system which communicates with and regulates the operation of the box filler 10. In the FIGS. 1–4, a control box 41 for the controller 18 is shown but the microprocessor is not shown. Using presently known computer hardware and easily programmable software and known scanning techniques for detecting light and the absence of light, the controller 18 communicates with the object sensor 16, monitors the information relayed from the object sensor 16 so that it can interpret the information received and count the objects 24 being conveyed, generates instructions for various components of the box filler 10, and tracks the location of each grouping assembly 32 from detection of objects 24 within that grouping assembly's 32 conveying trough to discharge into the receptacle 12. The controller 18 also monitors the number of objects 24 in each group of objects 24 discharged into the receptacle 12 so that instructions are sent to actuate and deactivate the trickle-feed conveyor 20, the receptacle conveyor 22, and the discharge of objects 24 into the receptacle 12.

Figure 2:
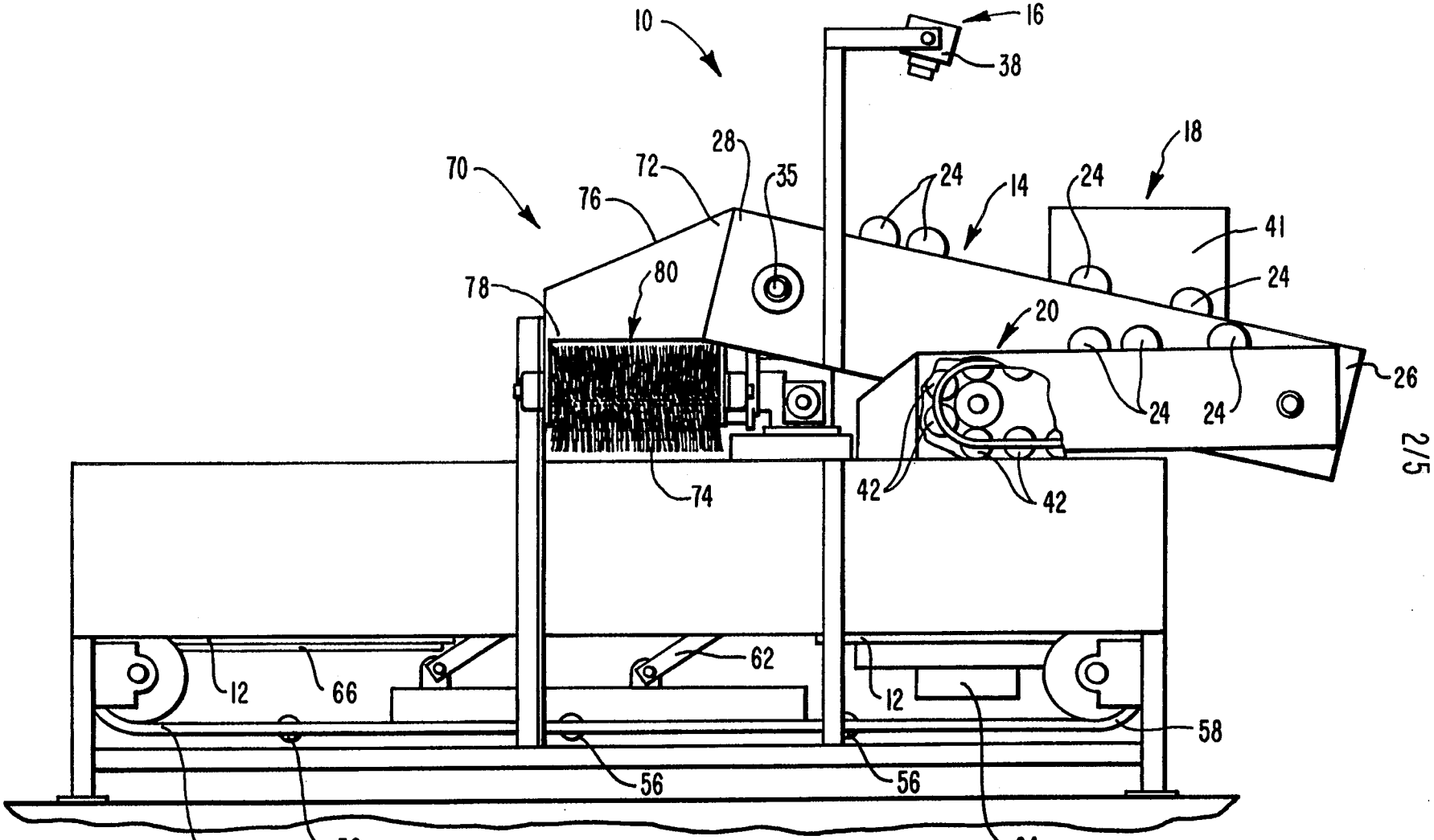
FIG. 2 is an elevational view of the apparatus of the present invention from the opposite side as is shown in FIG. 1 with a portion thereof cut away to show a portion of the trickle-feed conveyor.

The trickle-feed conveyor 20, best shown in FIGS. 2 and 3, conveys objects 24 for discharge one at a time into a rough-filled receptacle 12 in response to instructions received from the controller 18. After the conveyor 14 rough-fills a receptacle 12, the controller 18 which has monitored exactly how many objects 24 have been discharged into the receptacle 12 instructs the trickle-feed conveyor 20 to discharge a specific number of objects 24 into the receptacle 24. The trickle-feed conveyor 20 rapidly fills the roughfilled receptacle 12 to the desired count and/or weight.

Although the conveyor 14 may rough-fill a receptacle 12 to any amount up to the desired count (for example if the desired count is one hundred (100), the rough-fill could be up to fifty (50) or seventy-five (75) or ninety (90), it is preferred that the conveyor rough-fill the receptacle 12 to an amount where the next group of objects 24 would over fill the receptacle 12. For example, if the desired count is one hundred (100) and the receptacle 12 contains ninety-seven (97) objects 24 and the next conveying trough of a grouping assembly 32 is conveying five (5) objects 24, then further discharge by the conveyor 14 into the receptacle 12 would be stopped and the trickle-feed conveyor 20 would trickle-feed the needed three (3) objects 24 to bring the count to exactly one hundred (100). In this manner, throughput would be optimized because the more rapid filling conveyor 14 would be used to its fullest extent and use of the slower, one at a time trickle-feed conveyor 20 would be minimized.

Preferably, the trickle-feed conveyor 20 comprises a plurality of rollers 42 connected in an endless belt configuration and defining a plurality of conveying pockets, generally designated 44, between adjacent pairs of rollers 42, each said conveying pocket 44 being capable of supporting one of the objects 24 during conveyance. Each roller 42 has a length which is less than the width of two of the objects 24 placed side by side so that each conveying pocket 44 is capable of conveying only a single object 24.

As described above for the conveyor 14, to assure secure singulated, non-stacked travel of the objects 24 on the trickle-feed conveyor 20, the rollers 42 may be free to rotate about their longitudinal axis so that unstable objects 24 seeking a position of stability may cause one or more of the rollers 42 to rotate, or the rollers 42 may be rotated mechanically to move unstable objects 24 to a stable position for conveyance.

Disposed adjacent the trickle-feed conveyor 20 is a detector 46 for detecting the presence of one of the objects 24 within each conveying pocket 44 as each conveying pocket 44 passes the detector 46 during conveyance. Although there are numerous known ways for detecting whether or not an object 24 is being conveyed within a conveying pocket 44 such as weighing the load on each conveying pocket 44 or optically scanning through or across each conveying pocket 44, it is preferred that the detector 46 comprises a light source 48 and a light sensor 50 such as a light and a photoelectric cell that detects the light. The other ways for determining whether or not an object 24 occupies a conveying pocket 44 are certainly contemplated to be within the scope and intent of this invention.

Additionally, to assist in counting and monitoring objects 24 conveyed on the trickle-feed conveyor 20, the detector 46 may further comprise a trickle-feed encoder 52 which determines the presence of one of the conveying pockets 44 at the light source 48 and light sensor 50 portion of the detector 46 so that interrogation regarding the presence of one of the objects 24 occurs and the information received enables the controller 18 to monitor the number of objects 24 available for discharge from the trickle-feed conveyor 20 into the receptacle 12.

Since the trickle-feed conveyor 20 preferably operates only to trickle-feed a few objects 24 into an already roughfilled receptacle 12, preferably the trickle-feed conveyor 20 further comprises a trickle-feed clutch 54 for pausing the conveyance of objects 24 after the receptacle 12 is filled to the predetermined count and/or weight of objects 24 until a newly rough-filled receptacle 12 is positioned for further filling.

As is best shown in FIG. 2, connected to the trickle-feed conveyor 20 is a trickle-feed chute 56 for directing objects 24 from discharge from the trickle-feed conveyor 20 into the rough-filled receptacle 12.

The receptacle conveyor 22 positions receptacles 12 to receive objects 24 being discharged from the conveyor 14 and the trickle-feed conveyor 20. Although, the conveyance of receptacles 12 could be accomplished manually or with any number of conveyance configurations, the receptacle conveyor 22 to be described in more detail below is preferred because it is automated and can be controlled by the controller 18 to optimize efficiencies and maximize throughput. It should be understood however that other methods for conveying or advancing the receptacles 12 are contemplated and within the spirit and intent of the present invention.

The receptacle conveyor 22 of the present invention utilizes three basic stages of conveyance. At a first stage of conveyance (generally designated by the letter A), an empty receptacle 12 (e.g., a box or carton) is positioned for advancement to a second stage (generally designated by the letter B). Upon advancement to the second stage, the receptacle 12 is positioned in the proximity of the conveyor 14 so that the receptacle 12 receives objects 24 from the groups of objects 24 discharged from the conveyor 14. Preferably, groups of objects 24 are discharged into the receptacle 12 until the next group of objects 24 would cause the count of objects 24 to exceed the predetermined count. The receptacle conveyor 22 also moves the receptacle 12 to a third stage (generally designated by the letter C) in the proximity of the trickle-feed conveyor 20 so that the receptacle 12 can receive objects 24 discharged from the trickle-feed conveyor 20 until the receptacle 12 has received the predetermined count of objects.

The receptacle conveyor 22 comprises a plurality of box indexers 56 spaced apart upon an endless drive loop 58, guide rails 60, a lift mechanism 62, a load cell 64, a resting platform 66, and an indexer clutch 68. The box indexers 56 are spaced sufficiently that between each pair of adjacent box indexers 56 a receptacle 12 can nest for conveyance from stage one to stage two and then to stage three as the drive loop 58 is driven in accordance with instructions received from the controller 18. The guide rails 60 prevent undesirable lateral movement of the receptacle 12 (See FIG. 4).

As is best illustrated in FIG. 1, an empty receptacle 12 is disposed within stage one (letter A) between a pair of box indexers 56 and resting on the resting platform 66. The empty receptacle 12 is ready for advancement to stage two (letter B). A still empty receptacle 12 is disposed within stage two between a pair of box indexers 56 and resting on the lift mechanism 62. The lift mechanism 62 is weight sensitive and lifts an empty receptacle 12 closer to the point of discharge so that the objects 24 have only a short distance to fall into the receptacle 12. In this manner, injury to the objects 24 is minimized. As the receptacle 12 fills, the weight of its contents of objects 24 depresses the lift mechanism 62 until at a point when the receptacle 12 has nearly reached a rough-fill, the lift mechanism 62 is fully depressed and acts to support the receptacle 12 in a manner similar to the resting platform 66 in stage one. Once the receptacle 12 is rough-filled to a predetermined count or a predetermined weight at stage two, the endless drive loop 58 advances causing box indexers 56 to engage the rough-filled receptacle 12 in stage two and the empty receptacle 12 in stage one and advance each a stage.

In FIG. 1, a rough-filled receptacle 12 is disposed within stage three (letter C) and is resting on the load cell 64. So disposed, the rough-filled receptacle 12 is in position to receive objects 24 from the trickle-feed conveyor 20 until the receptacle 12 contains the exact predetermined count and/or weight of objects 24 as directed by the controller. Upon being filled to the count and/or weight, the load cell 64 determines the exact weight of the contents of the receptacle 12 and that weight is relayed to the controller 18. Given that exact weight and the exact count of objects 24 within the receptacle 12, the average weight of the objects 24 within that specific receptacle 12 can be determined by the controller 18. That average weight can be displayed on a digital read-out or recorded on some tangible medium. After the filled receptacle 12 is weighed, it can be removed from the receptacle conveyor 22 either manually or mechanically.

The controller 18 regulates the advancement of receptacles 12 from stage one to stage two to stage three by instructing the indexer clutch 68 to hold movement of the endless drive loop 58 until the receptacle 12 within stage two is rough-filled as desired. Then the indexer clutch 68 permits the endless drive loop 58 to advance all of the receptacles 12 on the receptacle conveyor 22.

Although, box filler 10 described herein above does not have an accumulator 70, each of the FIGS. 1–4 illustrate a box filler 10 with an accumulator 70. A box filler 10 will operate without an accumulator 70, but to maximize throughput and protection for the objects 24 being discharged from the conveyor 14, the use of an accumulator 70 is preferred.

The accumulator 70 of the present invention is disposed to receive groups of objects 24 as discharged from the conveyor 14 before directing the objects 24 into the receptacle 12. The accumulator 70 comprises a hopper 72 and at least one rotatable cylindrical brush 74. The hopper 72 has a mouth 76 for receiving discharged objects 24, a neck 78 for gathering the objects 24, and an opening 80 through which the objects 24 are directed into the receptacle 12. Preferably two cylindrical brushes 74 are disposed to obscure passage through the opening 80 unless the cylindrical brushes 74 are rotated in opposite directions (see the arrows in FIG. 4) so that objects 24 may pass between the pair of cylindrical brushes 74. The cylindrical brushes 74 have bristles that are soft enough not to damage the objects 24 but stiff enough not to allow passage between the cylindrical brushes 74 unless they are rotated. Additionally, a mechanically operated gate (not shown) may be employed to close any gap between brushes 74 so that objects are positively retained within the accumulator 70 until discharge is desired. The use of such a gate is particularly helpful if the objects are small and have a tendency to escape between the brushes 74.

In response to instructions from the controller 18, the cylindrical brushes 74 can be rotated and paused from rotation so that objects 24 pass into the receptacle 12 by passing between the cylindrical brushes 74 during rotation, and if rotation is paused, the objects 24 accumulate within the hopper 72 until rotation is recommenced.

By permitting objects 24 to accumulate within the hopper 72, further discharge of objects 24 into the receptacle 12 is stopped until a new empty receptacle 12 is positioned for receipt of objects 24. With the accumulator 70 operating in this fashion, precious time is saved because the conveyor 14 need not stop conveying once a receptacle 12 is rough-filled. The controller 18 need only pause the rotation of the cylindrical brushes 74 (and close the gate if a gate is provided) until the rough-filled receptacle 12 is advanced to stage three and an empty receptacle 12 is advanced to stage two. After such advancement is accomplished, the cylindrical brushes 74 recommence rotation (and the gate is opened), thereby permitting discharge of objects 24 into the newly positioned empty receptacle 12.

The accumulator 70 preferred and described herein utilizes a pair of cylindrical brushes 74; however, it should be understood that other accumulators could be used without departing from the spirit of the invention. For example, the accumulator could use a single cylindrical brush, or a gate, or any other mechanism that would permit passage therethrough and would prevent passage therethrough upon instruction from the controller 18 or upon manual actuation.

Figure 5:
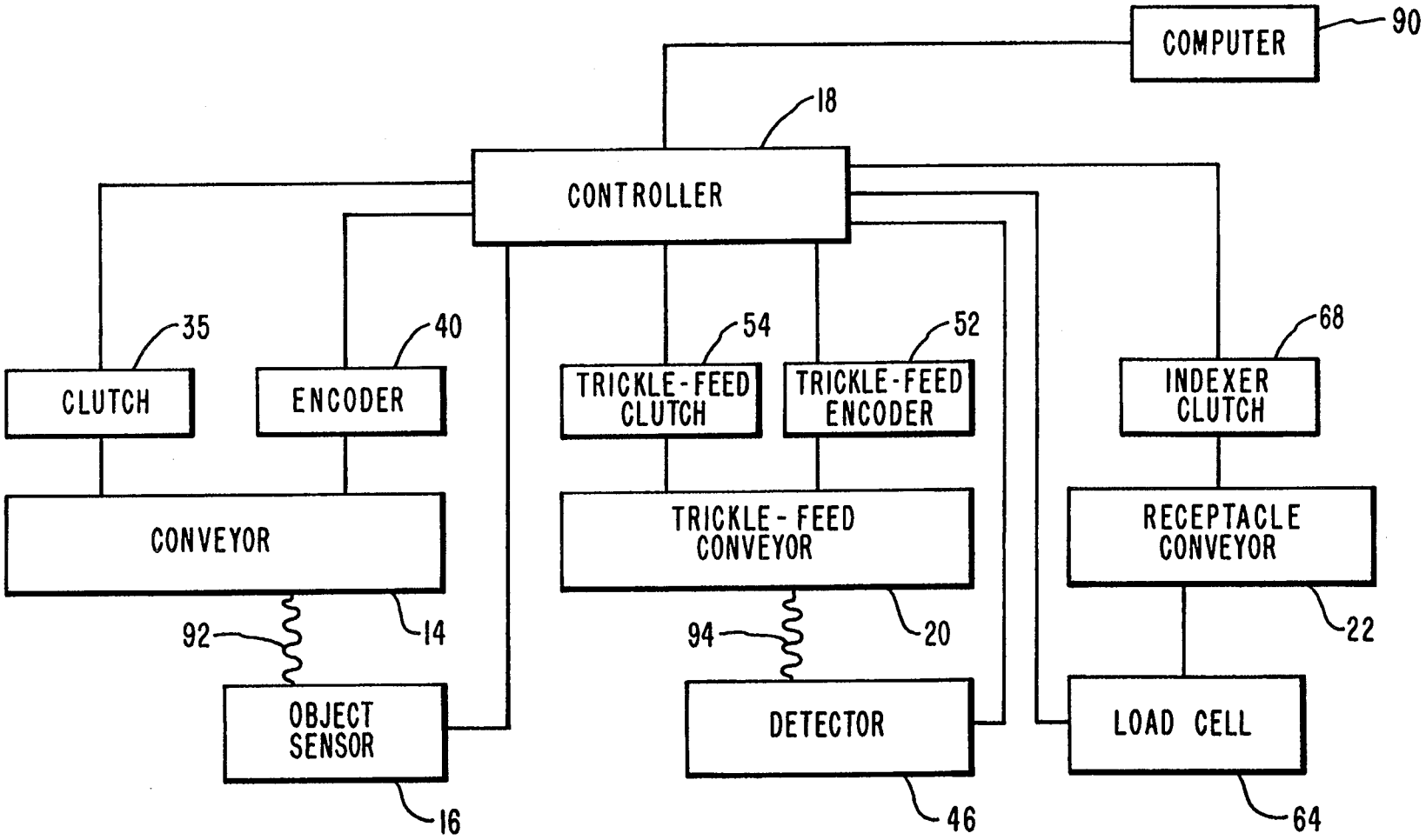
FIG. 5 is a diagrammatic representation of the various components of the present invention illustrating communicative interplay between the components.

FIG. 5 illustrates the interplay between various components of a preferred embodiment of the box filler 10 and shows the interconnection of the controller 18 with the conveyor 14, the trickle-feed conveyor 20, and the receptacle conveyor 22. As discussed above, the controller 18 comprises a computer microprocessor based system which communicates with and regulates the operation of the box filler 10. In FIGS. 1–4, a control box 41 for the controller 18 is shown but the microprocessor is not shown.

The controller 18 is connected to clutch 35 which controls the movement of conveyor 14. The controller 18 is also connected to the encoder 40 and the object sensor 16. The encoder 40 provides the controller 18 with information relating to when a gap 34 aligns properly with the object sensor 16. The object sensor 16 then scans (designated by wavy line 92) the gap to determine the number of objects 24 are within the group of objects 24 associated with the aligned gap 34, and provides the controller 18 with the information regarding the number of objects 24. The controller 18 tracks each gap 34 and the number of objects 24 from detection to discharge into a receptacle 12 and maintains a running count of the objects 24 which have been discharged into the receptacle 12. With the embodiment represented in FIG. 5, the controller 18 signals the clutch 35 to pause further advancement of the conveyor 14 when the next group of objects 24 would cause the count to exceed a predetermined count of objects 24. Of course; however, the controller 18 could be connected to an accumulator 70 which would be responsive to signals from the controller 18 and could regulate discharge of objects into the receptacle 12 without the use of a clutch 35 that would pause advancement of the conveyor 14.

The controller 18 is also connected to the trickle-feed clutch 54, the trickle-feed encoder 52, and the detector 46. The trickle-feed clutch 54 controls the advancement of the trickle-feed conveyor 20. The trickle-feed encoder 52 provides the controller 18 with information relating to when a conveying pocket 44 aligns properly with the detector 46. The detector 46 then detects (designated by wavy line 94) whether or not an object 24 rests within the conveying pocket 44, and provides the controller 18 with the information regarding the presence or absence of an object 24. The controller 18 tracks each conveying pocket 44 and which conveying pockets 44 have objects 24 from detection to discharge one at a time into a receptacle 12 and maintains a running count of the objects 24 which have been discharged into the receptacle 12. The controller 18 signals the trickle-feed clutch 54 to permit advancement of the trickle-feed conveyor 20 when a receptacle 12 which has not been filled to the desired count or weight is in position to receive objects 24 from the trickle-feed conveyor 20. Advancement is permitted until the receptacle 12 has been filled to the desired count or weight, and then the trickle-feed clutch 54 is signalled to pause further advancement of the trickle-feed conveyor 20 until the next receptacle 12 requiring objects 24 is in position.

The controller 18 of FIG. 5 is also connected to a load cell 64 and an indexer clutch 68 which controls the advancement of the receptacle conveyor 22. The load cell 64 weighs the contents of a receptacle 12 as it is being filled and/or when it is filled to a desired count. The load cell 64 provides the controller 18 with such weight information. Upon processing such information, the controller 18 calculates the average weight of each object 24 within the receptacle 12 and can signal the indexer clutch 68 to advance the filled receptacle 12.

By monitoring all of the information received, the controller 18 coordinates and tracks the movement of objects 24, counts the objects 24, counts the objects 24 discharged into a receptacle 12, weighs the contents of the receptacle 12, calculates the average weight of each object 24, and stores a running history of weight, count, and average weight. With this information, the controller 18 can vary the count to achieve desired weight with a known count, fill each receptacle 12 to an exact desired count, or fill each receptacle 12 to a desired weight. Hence, by monitoring the number of objects 24 required to fill the receptacle 12 over time the controller 18 may adjust the predetermined count of objects 24 so that the adding of objects 24 one at a time is minimized.

Additionally, the controller 18 may be connected to a computer 90 which can receive and process information from several controllers 18 at once. In this manner, the operation of multiple box fillers 10 can be coordinated and weight and count information for each receptacle 12 maintained.

In operation, the box filler 10 described herein can be used to count objects 24 dispensed into a receptacle 12 so that the receptacle 12 is rough-filled up to but not exceeding a predetermined count of objects 12, or it can be used to count objects 24 and determine the average weight of the objects 24 contained within each receptacle 12 which is filled to a predetermined count and/or weight.

To rough-fill a receptacle 12, presorted objects 24 are supplied to the receiving end 26 of the conveyor 14. The grouping assemblies 32, which are capable of supporting more than one object 24 during conveyance, capture groups of objects 24 for conveyance and convey such groups of objects 24 to the discharge end 28 of the conveyor 14 for discharge into the receptacle 12. As the groups of objects 24 are conveyed from the receiving end 26 to the discharge end 28 the object sensor 16 detects the presence of objects 24 within each group of objects 24 and relays information relating to the number of objects 24 within each group of objects 24 to the controller 18. The controller 18 monitors the number of objects 24 in each group of objects 24 and tracks the location of each group of objects 24 from detection to discharge into the receptacle 12. The controller also counts the number of objects 24 discharged into the receptacle 12 and pauses (using either the clutch 35 or the accumulator 70 or a combination of both) further discharge of objects 24 into the receptacle 12 if the next group of objects 24 would cause the count to exceed the predetermined count of objects 24.

To determine the average weight of the objects 24 contained within each receptacle 12 filled to a predetermined count, the steps described next above could be followed to rough fill each receptacle 12. Then, the receptacle 12 could receive objects 24 discharged from the trickle-feed conveyor 20 one at a time until the receptacle 12 has received the predetermined count and/or weight of objects 24. Once filled to a predetermined count and/or weight, the contents of the receptacle 12 are weighed exactly using a load cell or any other suitable weighing device. The average weight of the objects 24 within the receptacle 12 can then be calculated by dividing the exact weight determined by the exact count of objects 24.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for dispensing a predetermined count of objects into a receptacle, comprising:

a conveyor for conveying objects, said conveyor comprising a plurality of elongate cylindrical rollers connected in an endless belt configuration, said conveyor having at least one grouping assembly, each said grouping assembly capable of capturing a group of objects and supporting that group of objects during conveyance until that group of objects is discharged into the receptacle, each said grouping assembly comprising a pair of adjacent said cylindrical rollers disposed to support thereupon objects during conveyance, wherein the adjacent pairs of said cylindrical rollers in each grouping assembly are spaced so that there is a gap through which light may pass between said cylindrical rollers and said cylindrical rollers have a length greater than the width of at least two of objects placed side by side so that each grouping assembly is capable of supporting during conveyance at least two objects;

an object sensor disposed in sensory communication with said conveyor for detecting the presence of one of the groups of objects prior to discharge and relaying information relating to the number of objects within that group of objects;

a controller in communication with said object sensor for monitoring information relayed from said object sensor and for generating instructions, said controller being capable of tracking the location of each grouping assembly conveying one of the groups of objects from detection to discharge into the receptacle and monitoring the number of objects in each group of objects discharged into the receptacle so that the receptacle receives objects from the groups of objects discharged from the conveyor up to but not exceeding the predetermined count of objects; and a trickle-feed conveyor in communication with said controller and capable of conveying objects for discharge one at a time into the receptacle in response to instructions received from said controller, said trickle-feed conveyor discharges objects into the receptacle until the receptacle has received the predetermined count of objects.

2. An apparatus as set forth in claim 1, further comprising an accumulator disposed to receive groups of objects discharged from said conveyor and for directing the objects into the receptacle.

3. An apparatus as set forth in claim 2, wherein said accumulator comprises a hopper and a rotatable cylindrical brush, said hopper having a mouth for receiving discharged objects, a neck for gathering the objects, and an opening through which the objects are directed into the receptacle, said cylindrical brush being disposed to obscure passage through said opening unless said cylindrical brush is rotated.

4. An apparatus as set forth in claim 2, wherein said accumulator comprises a hopper and a pair of rotatable cylindrical brushes, said hopper having a mouth for receiving discharged objects, a neck for gathering the objects, and an opening through which the objects are directed into the receptacle, said pair of cylindrical brushes having parallel axes of rotation and being disposed adjacent each other to obscure passage through said opening unless said cylindrical brushes are rotated in opposite directions so that objects may pass between said pair of cylindrical brushes.

5. An apparatus as set forth in claim 4, wherein said pair of cylindrical brushes is in communication with said controller and responsive to instructions from said controller, said pair of cylindrical brushes rotates and pauses rotation thereby permitting objects to pass into the receptacle by passing between said pair of cylindrical brushes during rotation, and if rotation is paused, permitting objects to accumulate within said hopper until rotation is recommenced.

6. An apparatus as set forth in claim 1, further comprising a trickle-feed chute for directing objects from discharge from said trickle-feed conveyor into the receptacle.

7. An apparatus as set forth in claim 1, wherein said controller comprises a microprocessor.

8. An apparatus as set forth in claim 1, wherein said object sensor comprises a light emitter and a light detector, said light emitter being disposed in light communication with said light detector and adjacent said conveyor such that said light emitter emits light through said gap of one of said grouping assemblies for detection by said light detector when that grouping assembly passes between said light emitter and said light detector, said light detector also capable of detecting the absence of light in said gap if objects are being conveyed by said grouping assembly as said grouping assembly passes between said light emitter and said light detector.

9. An apparatus as set forth in claim 8, wherein said object sensor further comprises an encoder for determining when one of said gaps is disposed between said light emitter and said light detector and communicating the presence of said gap so that said light detector interrogates said gap for the presence of light and said controller is relayed the information for monitoring the number of objects being conveyed by said grouping assembly corresponding to said gap.

10. An apparatus as set forth in claim 8, wherein said light detector is a line scan camera.

11. An apparatus as set forth in claim 1, wherein said conveyor further comprises a clutch for pausing the conveyance of objects and for pausing the discharge of objects into the receptacle.

12. An apparatus for dispensing a predetermined count of objects into a receptacle, comprising:

a conveyor for conveying objects having at least one grouping assembly, each said grouping assembly capable of capturing a group of objects and supporting that group of objects during conveyance until that group of objects is discharged into the receptacle;

an object sensor disposed in sensory communication with said conveyor for detecting the presence of one of the groups of objects prior to discharge and relaying information relating to the number of objects within that group of objects;

a controller in communication with said object sensor for monitoring information relayed from said object sensor and for generating instructions, said controller being capable of tracking the location of each grouping assembly conveying one of the groups of objects from detection to discharge into the receptacle and monitoring the number of objects in each group of objects discharged into the receptacle so that the receptacle receives objects from the groups of objects discharged from the conveyor up to but not exceeding the predetermined count of objects; and a trickle-feed conveyor in communication with said controller and capable of conveying objects for discharge one at a time into the receptacle in response to instructions received from said controller, said trickle-feed conveyor discharges objects into the receptacle until the receptacle has received the predetermined count of objects, wherein said trickle-feed conveyor comprises a plurality of rollers connected in an endless belt configuration and defining a plurality of conveying pockets between adjacent pairs of rollers, each said conveying pocket being capable of supporting one of the objects during conveyance.

13. An apparatus as set forth in claim 12, wherein each roller has a length which is less than the width of two of the objects placed side by side so that each conveying pocket is capable of conveying only a single object.

14. An apparatus as set forth in claim 13, further comprising a detector disposed adjacent said trickle-feed conveyor for detecting the presence of one of the objects within each conveying pocket as each conveying pocket passes said detector.

15. An apparatus as set forth in claim 14, wherein said detector further comprises a trickle-feed encoder for determining the presence of one of said conveying pockets at the detector so that said detector is interrogated regarding the presence of one of the objects enabling said controller to monitor the number of objects for discharge into the receptacle.

16. An apparatus as set forth in claim 14, wherein said detector comprises a light source and a light sensor.

17. An apparatus for dispensing a predetermined count of objects into a receptacle, comprising:

a conveyor for conveying objects having at least one grouping assembly, each said grouping assembly capable of capturing a group of objects and supporting that group of objects during conveyance until that group of objects is discharged into the receptacle;

an object sensor disposed in sensory communication with said conveyor for detecting the presence of one of the groups of objects prior to discharge and relaying information relating to the number of objects within that group of objects;

a controller in communication with said object sensor for monitoring information relayed from said object sensor and for generating instructions, said controller being capable of tracking the location of each grouping assembly conveying one of the groups of objects from detection to discharge into the receptacle and monitoring the number of objects in each group of objects discharged into the receptacle so that the receptacle receives objects from the groups of objects discharged from the conveyor up to but not exceeding the predetermined count of objects; and a trickle-feed conveyor in communication with said controller and capable of conveying objects for discharge one at a time into the receptacle in response to instructions received from said controller, said trickle-feed conveyor discharges objects into the receptacle until the receptacle has received the predetermined count of objects, wherein said trickle-feed conveyor comprises a clutch for pausing the conveyance of objects after the receptacle is filled to the predetermined count of objects.

18. A method for determining the average weight of the objects contained within each receptacle filled to a predetermined weight, comprising the steps of:

(a) supplying objects to a conveyor having at least one grouping assembly capable of supporting more than one object during conveyance;
(b) positioning the receptacle in the proximity of the conveyor so that the receptacle receives objects discharged from the conveyor;
(c) capturing a group of objects for supported conveyance on one of the grouping assemblies and conveying that group of objects to discharge into the receptacle;
(d) detecting the presence of objects within the group of objects;
(e) relaying information relating to the number of objects within the group of objects to a controller;
(f) monitoring the number of objects in each group of objects conveyed for discharge into the receptacle;
(g) tracking the location of each group of objects from detection to discharge into the receptacle;
(h) counting the number of objects discharged into the receptacle;
(i) pausing further discharge of objects into the receptacle if the next group of objects to discharge objects into the receptacle contains a number of objects that would cause the count to exceed a predetermined count of objects;
(j) moving the receptacle from the proximity of the conveyor to the proximity of a trickle-feed conveyor so that the receptacle can receive objects discharged from the trickle-feed conveyor;
(k) conveying objects on the trickle-feed conveyor for discharge one at a time into the receptacle until the contents of the receptacle weighs the predetermined weight and further discharge is ceased;
(l) weighing the contents of the receptacle after further discharge of objects one at a time into the receptacle is ceased;
(m) determining the count of objects within the receptacle after further discharge of objects one at a time into the receptacle is ceased; and
(n) dividing the weight determined from step (l) by the count of objects determined from step (m).

19. A method as set forth in claim 18, further comprising the steps of monitoring the number of objects required to fill the receptacle to the predetermined weight over time and adjusting the predetermined count so that the adding of objects one at a time is minimized.

20. An apparatus for dispensing a predetermined count of objects into a receptacle, comprising:

a conveyor for conveying objects having at least one grouping assembly, each said grouping assembly capable of capturing a group of objects and supporting that group of objects during conveyance until that group of objects is discharged into the receptacle;

an object sensor disposed in sensory communication with said conveyor for detecting the presence of one of the groups of objects prior to discharge and relaying information relating to the number of objects within that group of objects;

a controller in communication with said object sensor for monitoring information relayed from said object sensor and for generating instructions, said controller being capable of tracking the location of each grouping assembly conveying one of the groups of objects from detection to discharge into the receptacle and monitoring the number of objects in each group of objects discharged into the receptacle;

a trickle-feed conveyor in communication with said controller and capable of conveying objects for discharge one at a time into the receptacle in response to instructions received from said controller; and a receptacle conveyor in communication with said controller, said receptacle conveyor for positioning the receptacle in the proximity of said conveyor in response to instructions received from said controller so that the receptacle receives objects from groups of objects discharged from the conveyor up to but not exceeding the predetermined count of objects, said receptacle conveyor also being capable of moving the receptacle from the proximity of said conveyor to the proximity of said trickle-feed conveyor so that the receptacle can receive objects discharged from the trickle-feed conveyor until the receptacle has received the predetermined count of objects, said receptacle conveyor further comprises a load cell disposed beneath and supporting the receptacle if the receptacle is positioned in the proximity of said trickle-feed conveyor for weighing the objects contained within the container when the receptacle is filled to the predetermined count of objects.

21. A method for determining the average weight of the objects contained within each receptacle filled to a predetermined count, comprising the steps of:

(a) supplying objects to a conveyor having at least one grouping assembly capable of supporting more than one object during conveyance;
(b) positioning the receptacle in the proximity of the conveyor so that the receptacle receives objects discharged from the conveyor;
(c) capturing a group of objects for supported conveyance on one of the grouping assemblies and conveying that group of objects to discharge into the receptacle;
(d) detecting the presence of objects within the group of objects;
(e) relaying information relating to the number of objects within the group of objects to a controller;
(f) monitoring the number of objects in each group of objects conveyed for discharge into the receptacle;
(g) tracking the location of each group of objects from detection to discharge into the receptacle;
(h) counting the number of objects discharged into the receptacle;
(i) pausing further discharge of objects into the receptacle if the next group of objects to discharge objects into the receptacle contains a number of objects that would cause the count to exceed the predetermined count of objects;
(j) moving the receptacle from the proximity of the conveyor to the proximity of a trickle-feed conveyor so that the receptacle can receive objects discharged from the trickle-feed conveyor;
(k) conveying objects on the trickle-feed conveyor for discharge one at a time into the receptacle until the receptacle has received the predetermined count of objects;
(l) weighing the objects within the receptacle after the receptacle has received the predetermined count of objects; and
(m) dividing the weight determined from step (l) by the predetermined count of objects.

22. An apparatus for rough-filling a receptacle with objects up to but not exceeding a predetermined count of objects, comprising:

a conveyor for conveying objects, said conveyor comprising a plurality of elongate cylindrical rollers connected in an endless belt configuration, said conveyor having at least one grouping assembly, each said grouping assembly capable of capturing a group of objects and supporting that group of objects during conveyance until that group of objects is discharged into the receptacle, each said grouping assembly comprising a pair of adjacent said cylindrical rollers disposed to support thereupon objects during conveyance, wherein the adjacent pairs of said cylindrical rollers in each grouping assembly are spaced so that there is a gap through which light may pass between said cylindrical rollers and said cylindrical rollers have a length greater than the width of at least two of objects placed side by side so that each grouping assembly is capable of supporting during conveyance at least two objects;

an object sensor disposed in sensory communication with said conveyor for detecting the presence of one of the groups of objects prior to discharge and relaying information relating to the number of objects within that group of objects; and a controller in communication with said object sensor for monitoring information relayed from said object sensor and for generating instructions, said controller being capable of tracking the location of each grouping assembly conveying one of the groups of objects from detection to discharge into the receptacle and monitoring the number of objects in each group of objects discharged into the receptacle so that the receptacle receives objects from the groups of objects discharged from the conveyor up to but not exceeding the predetermined count of objects.

23. An apparatus as set forth in claim 22, further comprising an accumulator disposed to receive groups of objects discharged from said conveyor and for directing the objects into the receptacle.

24. An apparatus as set forth in claim 23, wherein said accumulator comprises a hopper and a rotatable cylindrical brush, said hopper having a mouth for receiving discharged objects, a neck for gathering the objects, and an opening through which the objects are directed into the receptacle, said cylindrical brush being disposed to obscure passage through said opening unless said cylindrical brush is rotated.

25. An apparatus as set forth in claim 23, wherein said accumulator comprises a hopper and a pair of rotatable cylindrical brushes, said hopper having a mouth for receiving discharged objects, a neck for gathering the objects, and an opening through which the objects are directed into the receptacle, said pair of cylindrical brushes having parallel axes of rotation and being disposed adjacent each other to obscure passage through said opening unless said cylindrical brushes are rotated in opposite directions so that objects may pass between said pair of cylindrical brushes.

26. An apparatus as set forth in claim 25, wherein said pair of cylindrical brushes is in communication with said controller and responsive to instructions from said controller, said pair of cylindrical brushes rotates and pauses rotation thereby permitting objects to pass into the receptacle by passing between said pair of cylindrical brushes during rotation, and if rotation is paused, permitting objects to accumulate within said hopper until rotation is recommenced.

27. An apparatus as set forth in claim 22, wherein said conveyor further comprises a clutch for pausing the conveyance of objects and for pausing the discharge of objects into the receptacle.

28. An apparatus as set forth in claim 22, wherein said controller comprises a microprocessor.

29. An apparatus as set forth in claim 22, wherein said object sensor comprises a light emitter and a light detector, said light emitter being disposed in light communication with said light detector and adjacent said conveyor such that said light emitter emits light through said gap of one of said grouping assemblies for detection by said light detector when that grouping assembly passes between said light emitter and said light detector, said light detector also capable of detecting the absence of light in said gap if objects are being conveyed by said grouping assembly as said grouping assembly passes between said light emitter and said light detector.

30. An apparatus as set forth in claim 29, wherein said object sensor further comprises an encoder for determining when one of said gaps is disposed between said light emitter and said light detector and communicating the presence of said gap so that said light detector interrogates said gap for the presence of light and said controller is relayed the information for monitoring the number of objects being conveyed by said grouping assembly corresponding to said gap.

31. An apparatus as set forth in claim 29, wherein said light detector is a line scan camera.

32. A method for counting objects dispensed into a receptacle so that the receptacle is rough-filled up to but not exceeding a predetermined count of objects, comprising the steps of:

(a) supplying objects to a conveyor having at least one grouping assembly capable of supporting more than one object during conveyance;

(b) capturing a group of objects for conveyance and conveying that group of objects to discharge into the receptacle;

(c) detecting the presence of objects within the group of objects;

(d) relaying information relating to the number of objects within the group of objects to a controller;

(e) monitoring the number of objects in each group of objects conveyed for discharge into the receptacle;

(f) tracking the location of each group of objects from detection to discharge into the receptacle;

(g) counting the number of objects discharged into the receptacle; and (h) pausing further discharge of objects into the receptacle if the next group of objects to discharge objects into the receptacle contains a number of objects that would cause the count to exceed the predetermined count of objects.

33. A method for dispensing objects into a receptacle so that the contents of the receptacle weighs a predetermined weight and the number of objects is determined, comprising the steps of:

(a) supplying objects to a conveyor having at least one grouping assembly capable of supporting more than one object during conveyance;

(b) capturing a group of objects for conveyance and conveying that group of objects to discharge into the receptacle;

(c) detecting the presence of objects within the group of objects;

(d) relaying information relating to the number of objects within the group of objects to a controller;

(e) monitoring the number of objects in each group of objects conveyed for discharge into the receptacle;

(f) tracking the location of each group of objects from detection to discharge into the receptacle;

(g) counting the number of objects discharged into the receptacle;

(h) pausing further discharge of objects into the receptacle if the next group of objects to discharge objects into the receptacle contains a number of objects that would cause the count to exceed a predetermined count of objects;

(i) adding objects one at a time to the contents of the receptacle until the weight of the contents of the receptacle weighs a predetermined weight; and (j) counting each object added one at a time to determine the number of objects contained within the receptacle when the predetermined weight of the contents is achieved.

34. A method as set forth in claim 33, further comprising the steps of monitoring the number of objects required to fill the receptacle to the predetermined weight over time and adjusting the predetermined count so that the adding of objects one at a time is minimized.

* * * * *